US006581679B2

(12) United States Patent
Fischer et al.

(10) Patent No.: US 6,581,679 B2
(45) Date of Patent: Jun. 24, 2003

(54) HEAT EXCHANGER AND METHOD FOR PRODUCING A HEAT EXCHANGER

(75) Inventors: Ewald Fischer, Bietigheim-Bissingen (DE); Matthias Jung, Stuttgart (DE); Wolfgang Seewald, Stuttgart (DE); Werner Storz, Calw (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/986,039

(22) Filed: Nov. 7, 2001

(65) Prior Publication Data

US 2002/0066553 A1 Jun. 6, 2002

(30) Foreign Application Priority Data

Nov. 7, 2000 (DE) ..... 100 56 074

(51) Int. Cl.[7] ..... F28F 9/02
(52) U.S. Cl. ..... 165/174; 165/153; 29/890.052
(58) Field of Search ..... 165/153, 174, 165/176; 29/890.052

(56) References Cited

U.S. PATENT DOCUMENTS

| | | | | |
|---|---|---|---|---|
| 5,477,919 A | * | 12/1995 | Karube | 165/176 |
| 5,737,952 A | | 4/1998 | Baumann et al. | 72/55 |
| 5,979,542 A | | 11/1999 | Inoue et al. | 165/133 |
| 6,012,511 A | * | 1/2000 | Shinmura et al. | 165/153 |
| 6,202,741 B1 | * | 3/2001 | Demuth et al. | 165/176 |
| 6,257,325 B1 | | 7/2001 | Watanabe et al. | 165/153 |
| 6,272,881 B1 | * | 8/2001 | Kuroyanagi et al. | 165/153 |
| 6,302,196 B1 | * | 10/2001 | Haussmann | 165/153 |
| 6,321,562 B1 | * | 11/2001 | Narahara et al. | 165/153 |
| 6,328,100 B1 | * | 12/2001 | Haussmann | 165/176 |

FOREIGN PATENT DOCUMENTS

| | | |
|---|---|---|
| DE | 91 11 412.8 | 12/1991 |
| DE | 40 41 671 | 6/1992 |
| DE | 35 11 952 | 11/1993 |
| DE | 195 32 860 | 3/1997 |
| DE | 198 26 881 | 12/1999 |
| DE | 198 14 050 | 1/2000 |
| DE | 199 50 128 | 4/2000 |
| DE | 100 25 362 | 11/2000 |

* cited by examiner

*Primary Examiner*—Henry Bennett
*Assistant Examiner*—Terrell McKinnon
(74) *Attorney, Agent, or Firm*—Foley & Lardner

(57) ABSTRACT

The invention relates to a heat exchanger, in particular to an evaporator for a vehicle air-conditioning system, having at least one header tank made from metal with a base section for the connection of heat-exchange tubes, and at least one longitudinal-side section. The longitudinal-side section has connection openings which are provided with at least one connection flange attached to the longitudinal-side section.

27 Claims, 3 Drawing Sheets

HEAT EXCHANGER AND METHOD FOR PRODUCING A HEAT EXCHANGER

BACKGROUND OF THE INVENTION

The present invention relates to a heat exchanger, in particular to an evaporator for a vehicle air-conditioning system, having at least one header tank made from metal with a base section or plate for the connection of heat-exchange tubes, and at least one longitudinal-side section. The invention also relates to a method for producing a heat exchanger.

Commonly assigned DE 198 26 881 A1 discloses a heat exchanger with at least one header tank made from sheet metal. The header tank is divided into two chambers in the longitudinal direction, and the ends of two rows of flat tubes arranged behind one another are inserted into the base section or plate of the header tank. The base section, two longitudinal-side sections and two cover sections of the two tank chambers, as well as a partition between the chambers, are produced integrally from a pretreated plate by bending about longitudinal edges. The ends of the tank are closed off by fitted covers, and connection tubes, via which the heat exchanger can be connected to a heat exchange medium circuit, are inserted into one of the covers. The heat exchanger is adapted to a specific installation situation by inserting specially adapted connection tubes into the heat exchanger during the production process.

SUMMARY OF THE INVENTION

The principal object of the invention is to achieve a simple and inexpensive design of a heal exchanger.

In accomplishing the objects of the invention, there has been provided in accordance with one aspect of the invention heat exchanger suitable for use in a vehicle air-conditioning system, comprising: at least one header tank made from metal with a base section for the connection of heat-exchange tubes, and at least one longitudinal-side section, wherein the longitudinal-side section includes a plurality of connection openings having at least one connection flange attached to the longitudinal-side section.

In accordance with another aspect of the invention, there has been provided a heat exchanger suitable for use in a vehicle air-conditioning system, comprising: at least one header tank made from metal with a base section for the connection of heat-exchange tubes, and at least one longitudinal-side section, wherein the longitudinal-side section has one or more at least essentially planar connection faces with a plurality of connection openings provided in the one or more connection faces, said openings being surrounded by integrally molded connection-tube stubs.

According to still another aspect of the invention, there is provided a method for producing a heat exchanger as described above, comprising providing a pretreated tubular body, and subjecting the tubular body to internal pressure-forming to produce the header tank having the at least essentially planar connecting faces.

According to another aspect of the invention, a method is provided for producing a heat exchanger as described above, comprising bending a pretreated sheet about longitudinal edges to form the at least one longitudinal-side section and the cover section of the header tank, and concurrently forming the sheet to form at least the connection faces and/or connection-tube stubs.

Finally, the present invention also provides a motor vehicle that embodies a heat exchanger as described above, in particular a vehicle having an air-conditioning system in which the evaporator comprises a heat exchanger according to the invention.

Further objects, features and advantages of the invention will become apparent from the detailed description of preferred embodiments which follows, when considered with the accompanying figures of drawings.

DETAILED DESCRIPTION OF PREFERRED EMBODIMENTS

Figure 1:
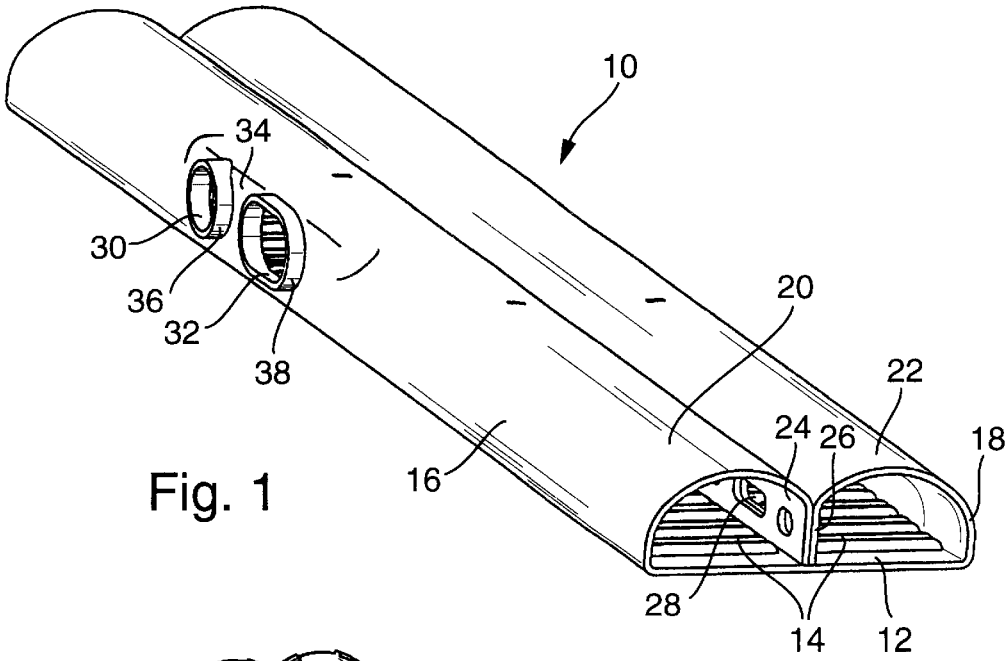
FIG. 1 is a perspective view of a header tank for a heat exchanger in accordance with a first preferred embodiment of the invention.

According to the invention, a heat exchanger, in particular an evaporator for a vehicle air-conditioning system, has at least one header tank made from metal with a base section or plate for the connection of heat-exchange tubes, and at least one longitudinal-side section. The longitudinal-side section has connection openings which are provided with at least one connection flange attached thereto. The provision of connection openings on the longitudinal-side section enables use of what is known as a longitudinal connection, in which necessary space located transversely to the air flow direction can be utilized completely for the heat-exchanger or evaporator block, i.e., additional space for connection tubes is not required transversely with respect to the direction of air flow. Providing the connection openings in the longitudinal-side section, i.e., directly on the header tank, leads to a simple structure without additional components. Since a connection flange is attached to the longitudinal-side section, an expansion-valve or tube-assembly connection can be integrated in the header tank. Consequently, the heat exchanger according to the invention can be used universally, since to adapt to a specific installation situation merely requires a change in the assembly of tubes that is to be connected to the connection flange. The process of producing the heat exchanger itself with integrated connection flange can remain unchanged irrespective of the final installation. Integrating an expansion valve on the header tank allows short flowpaths and a low pressure drop.

The object of the invention is also satisfied by providing a heat exchanger, in particular an evaporator for a vehicle air-conditioning system, in which at least one header tank made from metal, with a base section or plate for the connection of heat-exchange tubes and at least one longitudinal-side section. The longitudinal-side section has planar connection faces, and connection openings which are provided in the connection faces are surrounded by integrally molded connection-tube stubs. These measures enable connection tubes to be connected directly to the header tank and, for example, brazed thereto. Planar connection faces and integrally molded connection-tube stubs, particularly in the case of header tanks with longitudinal-side sections which are rounded transversely with respect to the longitudinal direction, allow an accurately fitting, stable arrangement of connection tubes. The connection openings may also be provided with at least one connection flange that is attached to the longitudinal-side section and can be oriented by simply being fitted on and pushed into the connection-tube stubs. The header tank may be of single-part or multi-part design, e.g., with separate base and cover components that enclose the longitudinal sides.

In a preferred embodiment of the invention, the connection openings are arranged adjacent to one another and are provided with a common connection-flange component. Consequently, it is merely necessary to orient and fit a single flange component for an inlet opening and an outlet opening on the tank. This simplifies production of the heat exchanger. The incoming and outgoing streams can be separated by providing a partition between the connection openings in the tank.

In a further preferred aspect of the invention, at least one of the connection openings has a generally oval cross section, with the longer axis of the oval cross section extending substantially in the longitudinal direction of the tank. This measure can, for example, produce a larger cross section of an outlet opening without exceeding the height of the connection openings that is predetermined by the design of the tank or by limited space available.

As a further preferred measure, the base section, the at least one longitudinal-side section and a cover section are formed integrally. An integral design of the base section, the longitudinal-side section and the cover section reduces the number of joints that have to be sealed.

In a further preferred embodiment of the invention, the tank is formed from a pretreated tubular body. By way of example, the manifold may be produced from an extruded section, resulting in a simple structure without the need to seal any joints between components in the longitudinal direction of the tank.

It is likewise advantageous if the tank is formed from a pretreated plate. A header tank of this type can be produced at particularly low cost as a bent sheet-metal part.

In another preferred aspect of the invention, the tank is connected to two rows of heat-exchange tubes arranged behind one another. Also, means for the multiple diversion of a fluid flow are provided in the heat exchanger between the sections of heat-exchange tubes belonging to one row and the sections of heat-exchange tubes belonging to the other row. This results in a more uniform temperature distribution than if the flow of fluid is only diverted once in the heat exchanger. By way of example, transverse and longitudinal walls or partitions are provided in the header tank for the purpose of diverting the flow of fluid.

In a preferred embodiment, a second header tank is connected to the first tank by means of the heat-exchange tubes, i.e., at the opposite end of the tubes. The means for multiple diversion in this case is designed in such a way that the flow of fluid, after entering the first header tank, flows through a first section of heat-exchange tubes belonging to a first row, passes into the second header tank, is diverted in the transverse direction and flows through a first section of heat-exchange tubes belonging to a second row, passes into the first header tank, is diverted in the longitudinal direction and flows through a second section of heat-exchange tubes belonging to the second row, passes into the second header tank, is diverted in the longitudinal direction and flows through a third section of heat-exchange tubes belonging to the second row, passes into the first tank, is diverted in the transverse direction and flows through a third section of heat-exchange tubes belonging to the first row, passes into the second tank, is diverted in the longitudinal direction and flows through a second section of heat-exchange tubes belonging to the first row, passes into the first tank and is discharged therefrom. This provides a passage of fluid in the heat exchanger which is particularly suitable for the intended fluid connection to a longitudinal-side section of the manifold and ensures a uniform temperature distribution of the air passing through the heat exchanger. By way of example, a stream of air through the heat exchanger initially comes into contact with the first row of the heat-exchange tubes.

According to the objects of the invention, there is also provided a method for producing a heat exchanger which involves the step of internal high-pressure forming of the pretreated tubular body. In this way, it is easy to form connection faces, connection-tube stubs and recesses with low tolerances in the header tank for connection to heat-exchange tubes.

The invention also provides a method for producing a heat exchanger which involves the step of bending the pretreated plate about longitudinal edges to form the at least one longitudinal-side section and the cover section. Connection faces and/or connection-tube stubs are shaped out at the same time as the bending step. As a result, connection faces which are provided for the arrangement of connection openings and are preferably planar can be formed at the same time as the bending operation involved in the production of the header tank. Particularly in the case of tanks with rounded sides, it is necessary to carry out a stamping-out or stamping-in operation in order to create planar connection faces. At the same time as the bending operation, it is also possible to form connection-tube stubs which make it easier to orient a connection flange which is to be fitted. At the same time that connection faces and/or connection-tube stubs are being formed, the connection openings themselves can also be made. In this case, advantageously, a plurality of connection faces are formed, for example, distributed symmetrically on the longitudinal-side section, whereby only the connection faces whose position is suitable for the intended application are selectively provided with connection openings.

Turning now to the drawings, FIG. 1 shows a header tank 10 which is produced integrally from a pretreated piece of sheet metal and has a base section 12, which is provided with passages 14 for the connection of heat-exchange tubes. Longitudinal-side sections 16 and 18 lead from both longitudinal edges of the base section 12 and are each adjoined by a cover section 20 or 22, respectively. Above the center of the base section 12, the cover sections 20 and 22 meet again and are bent down toward the base section 12, to form an intermediate-wall section 24 or 26, respectively. The intermediate-wall sections 24 and 26 bear against one another, and their lower edges are in contact with the base section 12. In this way, two collection channels running in the longitudinal direction of the header tank 10 are formed in the tank 10, these channels being in communication with one another via openings 28 at selected points in the intermediate-wall sections 24 and 26. The longitudinal-side section 16 of the header tank 10 has an inlet opening 30 and an outlet opening 32. The inlet opening 30 and the outlet opening 32 are provided in the region of a stamped-out portion 34 of the longitudinal-side section 16, which creates a planar or essentially planar surface for the arrangement of the connection openings 30 and 32. The inlet opening 30 and the outlet opening 32 are each surrounded by a connection-tube stub 36 or 38, respectively. The connection-tube stubs 36 and 38 make it significantly easier to fit and orient a connection flange. There is also a larger joining area available for the production of a brazed joint.

While the inlet opening 30 is shown in this embodiment as having a circular design, the outlet opening 32 is shown as oval in cross section, with a longer axis of the oval cross section extending in the longitudinal direction of the tank. In this way, it is possible to produce a larger cross section of the outlet opening 32 than the inlet opening 30, without exceeding the height of the connection openings 30 and 32, which is predetermined by the rounded shape of the longitudinal-side section 16 and the dimensions of the stamped-out portion 34. Other shapes for the openings 30 and 32 are also possible.

Figure 2:
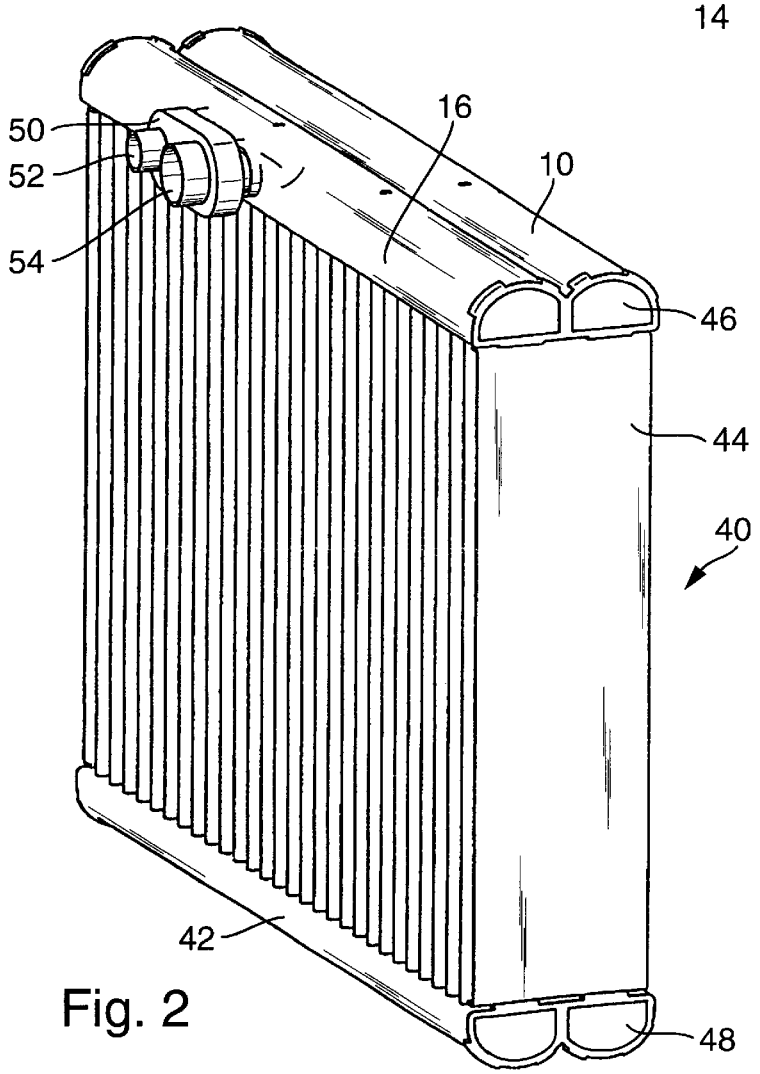
FIG. 2 is a perspective view of the heat exchanger in accordance with one preferred embodiment of the invention.

FIG. 2 shows a heat exchanger 40, for example, an evaporator for a vehicle air-conditioning system, in accordance with one preferred embodiment of the invention. The heat exchanger is provided with the header tank 10 as illustrated in FIG. 1 and a second header tank 42 at the lower end. The header tanks 10 and 42 are connected by heat-exchange tubes, which in the illustration shown in FIG. 2 are provided with a cladding or cover 44. The end sides of the tanks 10 and 42 are closed off by fitted covers 46 and 48, respectively.

A connection-flange component 50, which has a tube flange 52 connected to the inlet opening and a tube flange 54 connected to the outlet opening, is attached to the longitudinal-side section 16 of the tank 10. The tube flange 54 has a larger diameter than the tube flange 52, with the cross-sectional area of the tube flange 54 substantially corresponding to the cross-sectional area of the outlet opening. The tube flange 54 is used to convert the oval cross section of the outlet opening into a circular cross section which is suitable for the connection of conventional pipelines.

The connection-flange component 50 is fitted onto the connection openings arranged adjacent to one another and is attached to the connection-tube stub of the connection openings. An expansion valve or a tube assembly which is adapted to a specific installation situation can be attached directly to the connection component 50.

Figure 3:
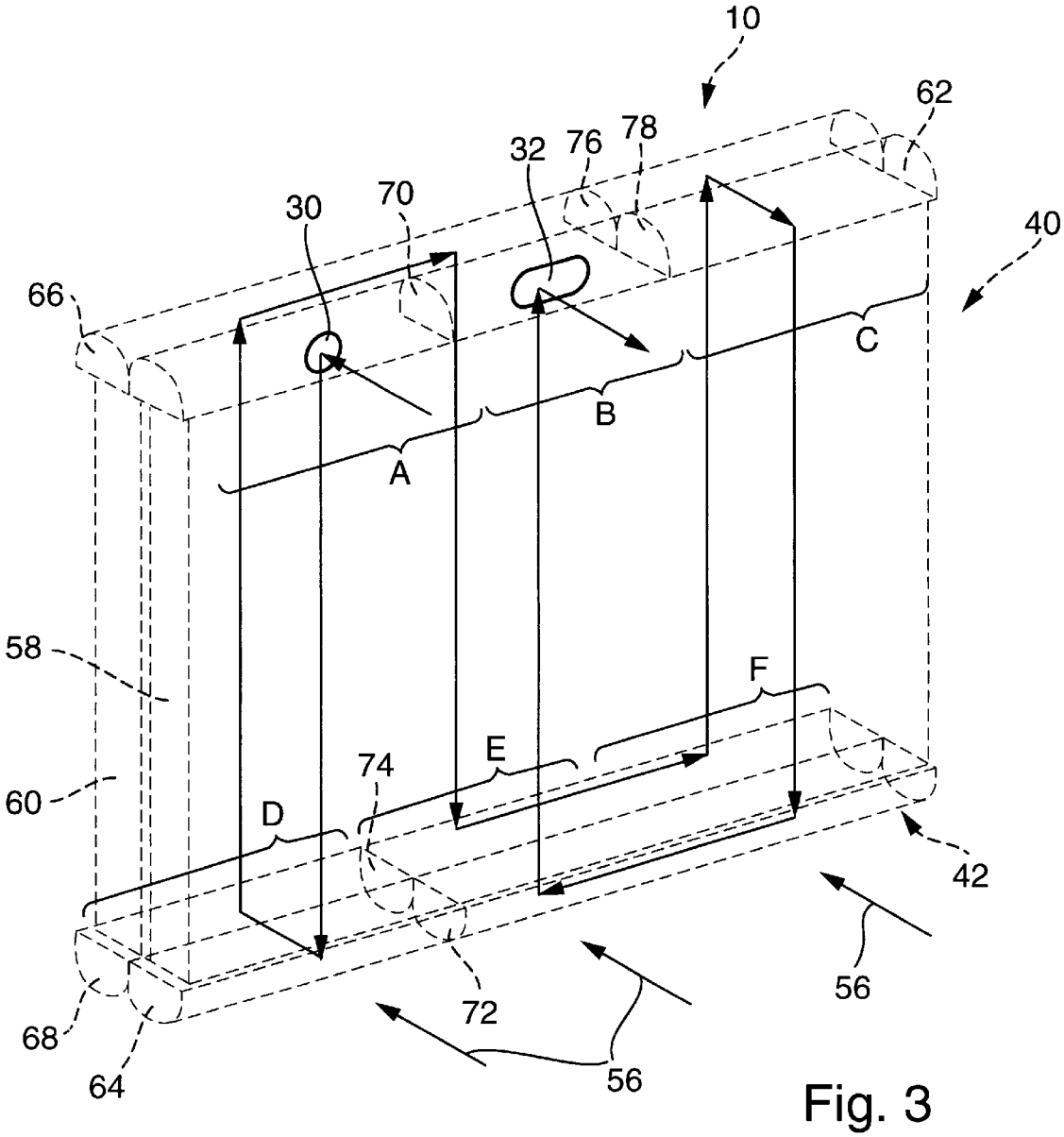
FIG. 3 diagrammatically depicts the flow of fluid in the heat exchanger shown in FIG. 2.

The diagrammatic illustration shown in FIG. 3 illustrates the path of fluid flow in the heat exchanger 40 illustrated in FIG. 2. An air stream passing through the heat exchanger 40 is indicated by arrows 56. The heat exchanger 40 has the header tanks 10 and 42, which are connected to one another by a first row 58 and a second row 60 of heat-exchange tubes. In detail, the first row 58 of heat-exchange tubes connects a collection channel 62 of the first header tank 10 to a collection channel 64 of the second header tank 42. The second row 60 of heat-exchange tubes connects a collection channel 66 of the first header tank 10 to a collection channel 68 of the second header tank 42. To guide the flow of fluid in the heat exchanger 40, longitudinal walls are provided between the collection channels 62 and 66 of the first header tank 10 and between the collection channels 64 and 68 of the second header tank 42, which longitudinal walls, as can be seen in FIG. 1, are provided with passage openings at selected locations. Furthermore, transverse walls or partitions 70, 72, 74, 76, 78, which at the provided locations prevent flow through the collection channels 62, 64, 66 and 68 in the longitudinal direction, are provided in the collection channels.

The flow of fluid, for example, a refrigerant, passes, as indicated by an arrow, into the inlet opening 30 and therefore into the collection channel 62 of the first header tank 10 The partition 70 prevents the fluid from being distributed over the entire length of the collection channel 62, and therefore the fluid flows through a first section A of heat-exchange tubes belonging to the first row 58 and passes into the collection channel 64 of the second header tank 42. In the collection channel 64, the fluid is prevented by a transverse wall 72 from being distributed over the entire length of the collection channel 64. Rather, the flow of fluid is diverted in the transverse direction of the header tank 42 in the collection channel 64 and passes, via passage openings in an intermediate wall between the collection channels 64 and 68, into the collection channel 68 of the second header tank 42. In the collection channel 68, there is a further transverse wall 74, so that the flow of fluid cannot be distributed over the entire length of the collection channel 68. Therefore, the fluid flows through a first section B of heat-exchange tubes belonging to the second row 60 and passes into the collection channel 66 of the first header tank 10. In the collection channel 66, the flow of fluid is diverted in the longitudinal direction of the tank 10 and flows along the collection channel 66 until it meets a transverse wall 76 which prevents the fluid from spreading further along the collection channel 66. Therefore, the flow of fluid once again changes its direction of flow by 90°, and the fluid flows downwardly through a second section E of heat-exchange tubes belonging to the second row and passes back into the collection channel 68, where, however, it is now on the other side of the transverse wall 74. The transverse wall 74 ensures that the fluid in the collection channel 68 of the second header tank 42 is diverted in the longitudinal direction of this header. In the collection channel 68, the direction of flow of the fluid is changed by 90°, and the fluid flows through a third section F of heat-exchange tubes belonging to the second row 60. As a result, the fluid passes back into the collection channel 66 of the first tank 10. In the collection channel 66, the fluid is diverted in the transverse direction of the tank 10 and passes through an intermediate wall between the collection channels 66 and 62 into the collection channel 62 of the first header tank 10. The fluid is prevented from spreading out in the longitudinal direction of the collection channel 62 by a transverse wall 78. Therefore, the fluid flows through a third section C of heat-exchange tubes belonging to the first row 58 and passes into the collection channel 64 of the second header tank 42. In the collection channel 64, the fluid is diverted in the longitudinal direction of the tank 42 and flows along the collection channel 64 until it comes into contact with the transverse wall 72. The fluid is diverted again by the transverse wall 72 and flows upwardly through a second section B of heat-exchange tubes belonging to the first row 58 and finally passes into a section of the collection channel 62 of the first header tank 10, which lies between the transverse walls 70 and 78. Then, starting from the collection channel 62, the fluid is discharged again from the heat exchanger 40 through the outlet opening 32.

The described passage of fluid in the heat exchanger 40 creates a flow of fluid which is adapted to the position of the inlet opening 30 and of the outlet opening 32 in the longitudinal side wall of the header tank 10 and leads to a uniform temperature distribution of the stream of air 56 passing through the heat exchanger 40.

The fluid may also flow through the heat exchanger 40 in a reverse order to that outlined above, so that the fluid enters the opening 32 and is discharged from the opening 30. This too leads to a uniform temperature distribution.

Figure 4:
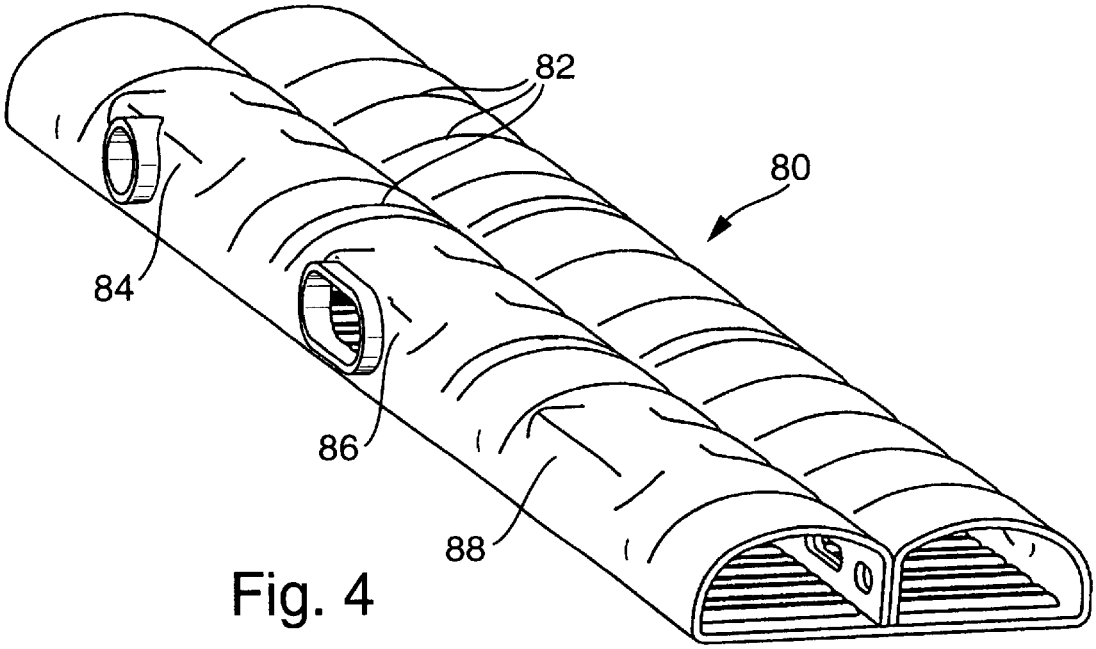
FIG. 4 is a perspective view of a header tank for a heat exchanger in accordance with a second preferred embodiment of the invention.

The header tank 80 which is illustrated in perspective in FIG. 4 is, like the header tank 10 shown in FIG. 1, constructed as a single part, but at its cover sections it has stamped-in portions 82 which run in the transverse direction of the tank 80 and additionally reinforce the tank 80. The header tank 80 is provided with three planar connection faces 84, 86 and 88. Only the connection faces 84 and 86 are provided with, in each case, one connection opening. The connection faces 84, 86 and 88 are formed during the production of the header tank 80 and are arranged symmetrically over the length of the tank 80. After the planar connection faces 84, 86 and 88 have been formed on the tank, only those connection faces, namely, the connection faces 84 and 86, whose position is suitable for the intended installation situation of the heat exchanger, are provided with connection openings. In this way, the header tank 80 can be adapted to various installation situations.

Figure 5:
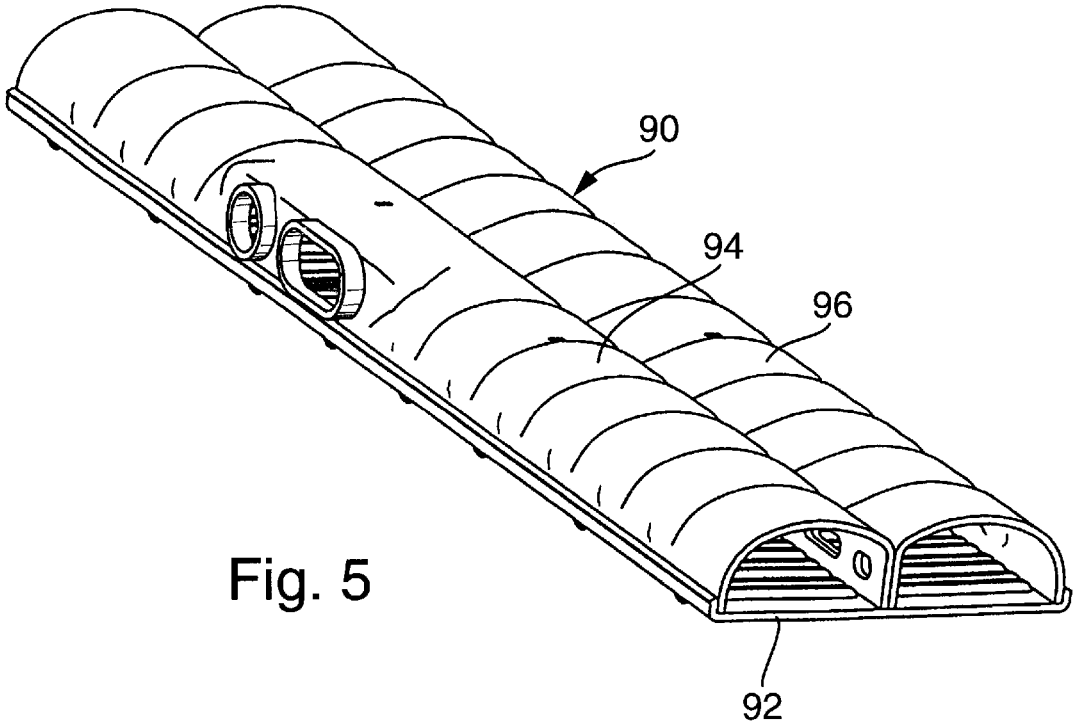
FIG. 5 is a perspective view of a header tank for a heat exchanger in accordance with a third embodiment of the invention.

Unlike the header tanks shown in FIG. 1 and FIG. 4, the header tank 90 shown in perspective in FIG. 5 is of three-part structure. The header tank 90 comprises a base section 92, which is bent over at its longitudinal sides, making it U-shaped. Two cover and longitudinal-side sections 94 and 96 are inserted into the U-shaped base section 92 and are connected to the base section 92, for example, by brazing. According to this modular principle, the three-part structure of the header tank 90 allows it to be adapted to various installation situations by changing over the components 92, 94 and 96; however, depending on the installation situation, it is also possible to combine different cover and longitudinal-side components.

The right of priority is claimed under 35 U.S.C. §119(a) for German Patent Application No. 100 56 074.1, filed Nov. 7, 2000, the entire contents of which are hereby incorporated by reference.

The foregoing embodiments have been shown for illustrative purposes only and are not intended to limit the scope of the invention which is defined by the claims.

What is claimed is:

1. A heat exchanger suitable for use in a vehicle air-conditioning system, comprising:

at least one header tank made from metal with a base section for the connection of heat-exchange tubes, and at least one longitudinal-side section, wherein the longitudinal-side section has one or more at least essentially planar connection faces with a plurality of connection openings provided in the one or more connection faces, said openings being surrounded by integrally molded connection-tube stubs, wherein the heat exchanger comprises two header tanks, each one connected at opposite ends of two rows of heat-exchange tubes arranged behind one another, and wherein the header tanks include flow guides for the multiple diversion of fluid flow in the heat exchanger between sub-groups of heat-exchange tubes belonging to one row and sub-groups of heat-exchange tubes belonging to the other row.

2. A heat exchanger as claimed in claim 1, further comprising at least one connection flange which is attached to the connection openings of the longitudinal-side section.

3. A heat exchanger as claimed in claim 2, comprising at least two connection openings arranged adjacent to one another and a common connection-flange.

4. A heat exchanger as claimed in claim 3, wherein at least one of the connection openings has a generally oval cross section, with the longer axis of the oval cross section extending substantially in the longitudinal direction of the header tank.

5. A heat exchanger as claimed in claim 1, wherein the base section, the at least one longitudinal-side section and a cover section of the header tank are formed integrally.

6. A heat exchanger as claimed in claim 1, wherein the header tank is formed from a pretreated tubular body.

7. A heat exchanger as claimed in claim 1, wherein the header tank is formed from a pretreated sheet.

8. A heat exchanger as claimed in claim 1, wherein the flow guides are designed in such a way that a fluid, after it has entered the first header tank, flows through a first section (A) of heat-exchange tubes belonging to the first row, passes into the second header tank, is diverted in the transverse direction and flows through a first section (D) of heat-exchange tubes belonging to the second row, passes into the first header tank, is diverted in the longitudinal direction and flows through a second section (E) of heat-exchange tubes belonging to the second row, passes into the second header tank, is diverted in the longitudinal direction and flows through a third section (F) of heat-exchange tubes belonging to the second row, passes into the first header tank, is diverted in the transverse direction and flows through a third section (C) of heat-exchange tubes belonging to the first row, passes into the second header tank, is diverted in the longitudinal direction and flows through a second section (B) of heat-exchange tubes belonging to the first row, passes into the first header tank and is discharged therefrom.

9. A heat exchanger as claimed in claim 1, wherein the flow guides comprise partitions formed in the header tanks.

10. A heat exchanger as claimed in claim 1, comprising at least three of said at least essentially planar connection faces, wherein said connection openings are selectively formed in less than all of said connection faces.

11. A method for producing the heat exchanger comprised of at least one header tank made from metal with a base section for the connection of heat-exchange tubes, and at least one longitudinal-side section, wherein the longitudinal-side section has one or more at least essentially planar connection faces with a plurality of connection openings provided in the one or more connection faces, said openings being surrounded by integrally molded connection-tube stubs, wherein the heat exchanger comprises two header tanks, each one connected at opposite ends of two rows of heat-exchange tubes arranged behind one another, and wherein the header tanks include flow guides for the multiple diversion of fluid flow in the heat exchanger between sub-groups of heat-exchange tubes belonging to one row and sub-groups of heat-exchange tubes belonging to the other row, comprising providing a pretreated tubular body, and subjecting said tubular body to internal pressure-forming to produce said header tank having said at least essentially planar connecting faces.

12. A method for producing the heat exchanger comprised of at least one header tank made from metal with a base section for the connection of heat-exchange tubes, and at least one longitudinal-side section, wherein the longitudinal-side section has one or more at least essentially planar connection faces with a plurality of connection openings provided in the one or more connection faces, said openings being surrounded by integrally molded connection-tube stubs, wherein the heat exchanger comprises at least three of said at least essentially planar connection faces, and wherein said connection openings are selectively formed in less than all of said connection faces, comprising bending a pretreated sheet about longitudinal edges to form the at least one longitudinal-side section and the cover section of said header tank, and concurrently forming the sheet to form at least said connection faces.

13. In a motor vehicle having an air-conditioning system embodying a heat exchanger, the heat exchanger comprising a heat exchanger as defined by claim 1.

14. A motor vehicle as claimed in claim 13, wherein the heat exchanger comprises an evaporator.

15. A heat exchanger suitable for use in a vehicle air-conditioning system, comprising:

at least one header tank made from metal with a base section for the connection of heat-exchange tubes, and at least one longitudinal-side section, wherein the longitudinal-side section has one or more at least essentially planar connection faces with a plurality of connection openings provided in the one or more connection faces, said openings being surrounded by integrally molded connection-tube stubs, wherein the heat exchanger comprises at least three of said at least essentially planar connection faces, and wherein said connection openings are selectively formed in less than all of said connection faces.

16. A heat exchanger as claimed in claim 15, wherein the essentially planar connection faces are formed in the longitudinal-side section during manufacture of the header tank.

17. A heat exchanger as claimed in claim 15, comprising two header tanks, each one connected at opposite ends of two rows of heat-exchange tubes arranged behind one another, and wherein the header tanks include flow guides for the multiple diversion of fluid flow in the heat exchanger between sub-groups of heat-exchange tubes belonging to one row and sub-groups of heat-exchange tubes belonging to the other row.

18. A heat exchanger as claimed in claim 17, wherein the flow guides are designed in such a way that a fluid, after it has entered the first header tank, flows through a first section (A) of heat-exchange tubes belonging to the first row, passes into the second header tank, is diverted in the transverse direction and flows through a first section (D) of heat-exchange tubes belonging to the second row, passes into the first header tank, is diverted in the longitudinal direction and flows through a second section (E) of heat-exchange tubes belonging to the second row, passes into the second header tank, is diverted in the longitudinal direction and flows through a third section (F) of heat-exchange tubes belonging to the second row, passes into the first header tank, is diverted in the transverse direction and flows through a third section (C) of heat-exchange tubes belonging to the first row, passes into the second header tank, is diverted in the longitudinal direction and flows through a second section (B) of heat-exchange tubes belonging to the first row, passes into the first header tank and is discharged therefrom.

19. A heat exchanger as claimed in claim 15, further comprising at least one connection flange which is attached to the connection openings of the longitudinal-side section.

20. A heat exchanger as claimed in claim 19, comprising at least two connection openings arranged adjacent to one another and a common connection-flange.

21. A heat exchanger as claimed in claim 20, wherein at least one of the connection openings has a generally oval cross section, with the longer axis of the oval cross section extending substantially in the longitudinal direction of the header tank.

22. A heat exchanger as claimed in claim 15, wherein the base section, the at least one longitudinal-side section and a cover section of the header tank are formed integrally.

23. A heat exchanger as claimed in claim 15, wherein the header tank is formed from a pretreated tubular body.

24. A heat exchanger as claimed in claim 15, wherein the header tank is formed from a pretreated sheet.

25. In a motor vehicle having an air-conditioning system embodying a heat exchanger, the heat exchanger comprising a heat exchanger as defined by claim 17.

26. A motor vehicle as claimed in claim 25, wherein the heat exchanger comprises an evaporator.

27. A method as claimed in claim 12, further comprising selectively forming the connection openings in less than all of said connection faces.

* * * * *